US006955499B2

(12) United States Patent
Sondrup

(10) Patent No.: US 6,955,499 B2
(45) Date of Patent: Oct. 18, 2005

(54) ADJUSTABLE UTILITY ACCESS

(75) Inventor: Chris Sondrup, Lindon, UT (US)

(73) Assignee: Precision Cover Systems, Inc., Lindon, UT (US)

( * ) Notice: Subject to any disclaimer, the term of this patent is extended or adjusted under 35 U.S.C. 154(b) by 119 days.

(21) Appl. No.: 10/671,337

(22) Filed: Sep. 25, 2003

(65) Prior Publication Data

US 2004/0120762 A1 Jun. 24, 2004

Related U.S. Application Data

(63) Continuation-in-part of application No. 10/262,578, filed on Oct. 1, 2002, now Pat. No. 6,695,526, and a continuation-in-part of application No. 10/262,560, filed on Sep. 30, 2002, now Pat. No. 6,799,920, and a continuation-in-part of application No. 09/815,411, filed on Mar. 22, 2001, now Pat. No. 6,520,713, and a continuation-in-part of application No. 09/814,627, filed on Mar. 22, 2001, now Pat. No. 6,524,026, which is a continuation of application No. 09/653,714, filed on Sep. 1, 2000, now Pat. No. 6,457,901, which is a continuation-in-part of application No. 09/653,714, filed on Sep. 1, 2000, now Pat. No. 6,457,901.

(51) Int. Cl.[7] ..... E02D 29/14
(52) U.S. Cl. ..... 404/26
(58) Field of Search ..... 404/26, 25

(56) References Cited

U.S. PATENT DOCUMENTS

| | | | | |
|---|---|---|---|---|
| 275,785 A | | 4/1883 | Omensetter | |
| 599,441 A | | 2/1898 | Dorr | |
| 599,457 A | * | 2/1898 | Sanborn | 404/26 |
| 638,692 A | | 12/1899 | Banwell | |
| 689,224 A | | 12/1901 | Pillsbury | |
| 814,013 A | | 3/1906 | Baumann | |
| 1,165,044 A | | 12/1915 | Tyler | |
| 1,257,324 A | | 2/1918 | Daniels | |
| 1,447,256 A | | 3/1923 | Lincoln | |
| 1,639,495 A | | 8/1927 | Frame | |
| 3,611,889 A | | 10/1971 | Levinson | |
| 4,158,515 A | | 6/1979 | Helms | |
| 4,174,183 A | | 11/1979 | Ferns | |
| 4,197,031 A | | 4/1980 | Hild | |
| 4,273,467 A | | 6/1981 | Cronk | |
| 4,337,005 A | | 6/1982 | LeBaron | |
| 4,883,590 A | | 11/1989 | Papp | |
| 4,906,128 A | | 3/1990 | Trudel | |
| 4,969,770 A | | 11/1990 | Bowman | |
| 5,044,674 A | | 9/1991 | Hendrikson | |
| 5,051,022 A | | 9/1991 | Bowman | |
| 5,211,504 A | | 5/1993 | Trudel | |
| 5,299,884 A | * | 4/1994 | Westhoff et al. | 404/25 |
| 5,360,131 A | | 11/1994 | Phillipps et al. | |
| 5,366,317 A | | 11/1994 | Solimr | |
| 5,451,119 A | | 9/1995 | Hondulas | |
| 5,470,172 A | | 11/1995 | Wiedrich | |
| 5,496,128 A | | 3/1996 | Odill | |
| 5,513,926 A | | 5/1996 | Prescott | |
| 5,564,855 A | | 10/1996 | Anderson | |
| 5,813,797 A | | 9/1998 | Pendleton et al. | |
| 5,899,629 A | * | 5/1999 | Milo et al. | 404/25 |
| 5,956,905 A | | 9/1999 | Wiedrich | |
| 6,109,824 A | | 8/2000 | Annes | |

OTHER PUBLICATIONS

"Valve Boxes and Cover" ; East Jordan Iron Works, Inc. Catalog VB2002 PO BOX 439, East Jordan, Michigan 49727.

* cited by examiner

*Primary Examiner*—Gary S. Hartmann
(74) *Attorney, Agent, or Firm*—Thorpe North & Western

(57) ABSTRACT

A utility access device and method includes telescoping, elongated upper and lower sleeves with an inclined upper edge. An angled ring is rotatably disposed on the inclined upper edge and has upper and lower opposite edges forming an inclined angle. The angled ring can be rotated to achieve a desired angle. A cover is removably disposed on the angled ring. An enlarged portion can be formed on the lower sleeve to straddle a utility, such as a valve.

22 Claims, 2 Drawing Sheets

ADJUSTABLE UTILITY ACCESS

This application is a continuation-in-part of U.S. patent application Ser. No. 10/262,578, filed Oct. 1, 2002 now U.S. Pat No. 6,695,526; which is a continuation of U.S. patent application Ser. No. 09/653,714 now U.S. Pat. No. 6,457,901, filed Sep. 1, 2000; and a continuation-in-part of U.S. patent application Ser. No. 10/262,560, filed Sep. 30, 2002 now U.S. Pat. No. 6,799,920; which is a continuation-in-part of U.S. patent application Ser. No. 09/653,714 now U.S. Pat. No. 6,457,901, filed Sep. 1, 2000; U.S patent application Ser. No. 09/815,411 now U.S. Pat. No. 6,520,713, filed Mar. 22, 2001; and U.S. patent application Ser. No. 09/814,627 now U.S. Pat. No. 6,524,026, filed Mar. 22, 2001; which are herein incorporated by reference.

BACKGROUND OF THE INVENTION

1. Field of the Invention

The present invention relates generally to a utility access, such as a valve access. More particularly the present invention relates to an angle adjustable utility access and method for aligning a cover to sit flush with a surrounding surface.

2. Related Art

A utility access provides access to various underground equipment associated with various utilities. Examples of utilities include sewer pipelines or systems, electrical cables or systems, telephone cables or systems, natural gas lines or systems, gas or oil pipelines or systems, cable television lines or systems, water or drainage pipelines or systems, etc. Examples of equipment associated with the utilities include pipelines, cables, valves, meters, switches, storage, etc. The utility access can be large enough for a worker to physically pass therethough, such as a manhole, or can be smaller providing only visual access, such as for a meter, or providing only tool access, such as for a valve.

As an example, a valve box allows access to an underground valve. Such valve boxes usually have an adjustable length or height to accommodate valves at various depths. The valve boxes have a diameter sized to allow a tool to extend from the surface, through the valve box, and to the valve. Thus, such valve boxes are typically long and narrow. The opening of the valve box can be positioned in an area carrying traffic, such as a roadway. Thus, the valve box often must be strong enough to withstand various external loadings, for example the loading of vehicles moving over the valve box.

In one situation, road surfaces are often sloped to resist the accumulation of water on the road surface. It will be appreciated that it is often difficult to match the orientation of the valve box cover with the slope of the road.

SUMMARY OF THE INVENTION

It has been recognized that it would be advantageous to develop a method and an apparatus for installing an adjustable utility access or an adjustable valve box.

The invention provides a utility access device to extend access from a ground surface to a utility includes a pair of telescoping, elongated upper and lower sleeves that together have upper and lower ends. The sleeves are displacable with respect to one another so that the sleeves together have an adjustable length between the upper and lower ends. The lower sleeve can include an enlarged portion to extend over and along side a utility. The upper sleeve can include an inclined upper edge having an angle with respect to horizontal greater than 0 degrees.

An angled ring is rotatably disposed on the inclined upper edge of the upper sleeve. The angled ring has upper and lower opposite edges forming an angle therebetween greater than 0 degrees. The ring is rotatable with respect to the upper sleeve to vary the angle of a cover removably disposed on the angled ring.

A method for adjusting a utility access to a utility with respect to a ground surface includes positioning the utility access in a hole extending from the ground surface to the utility. An enlarged bottom end of the utility access can be disposed over and along side the utility. An upper sleeve of the utility access can be displaced with respect to a lower sleeve of the utility access so that the utility access extends between the utility and the ground surface. An angled ring is rotated on an inclined upper edge of the upper sleeve until a top of the ring is substantially parallel with the ground surface.

Additional features and advantages of the invention will be apparent from the detailed description which follows, taken in conjunction with the accompanying drawings, which together illustrate, by way of example, features of the invention.

DETAILED DESCRIPTION

Figure 1:
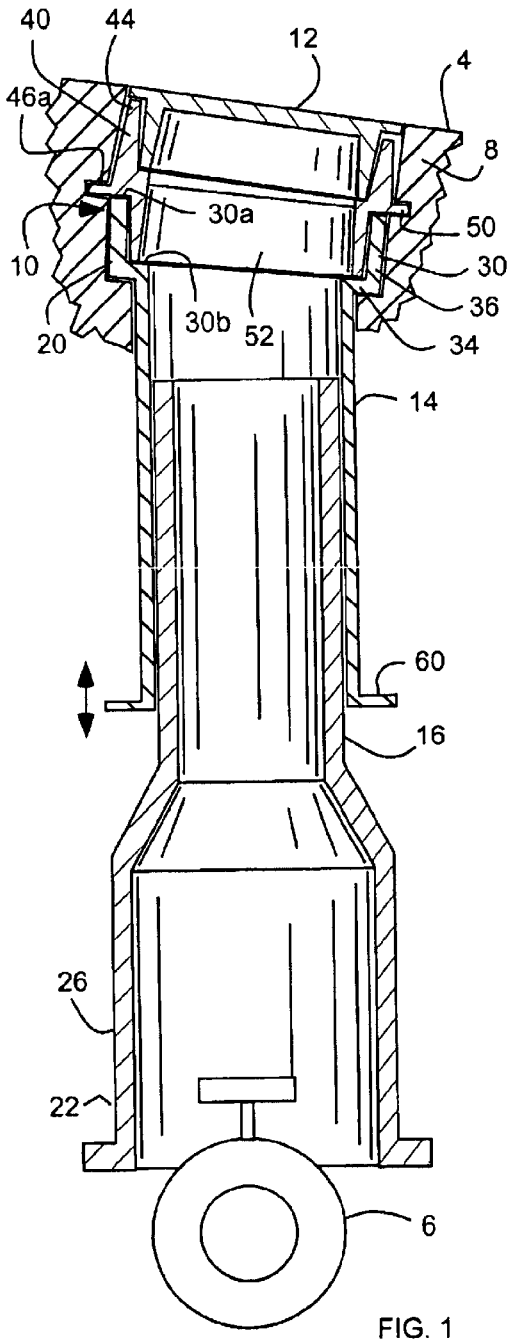
FIG. 1 is a cross-sectional side view of an angle adjustable utility access device in accordance with an embodiment of the present invention shown in an angled configuration with a utility and a surface or roadway.

Reference will now be made to the exemplary embodiments illustrated in the drawings, and specific language will be used herein to describe the same. It will nevertheless be understood that no limitation of the scope of the invention is thereby intended. Alterations and further modifications of the inventive features illustrated herein, and additional applications of the principles of the inventions as illustrated herein, which would occur to one skilled in the relevant art and having possession of this disclosure, are to be considered within the scope of the invention.

Figure 2:
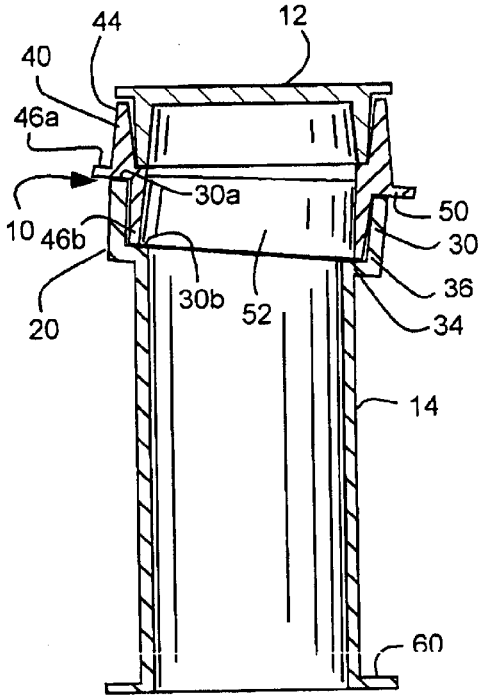
FIG. 2 is a cross-sectional side view of the angle adjustable utility access device of FIG. 1, shown in a level configuration.
Figure 3:
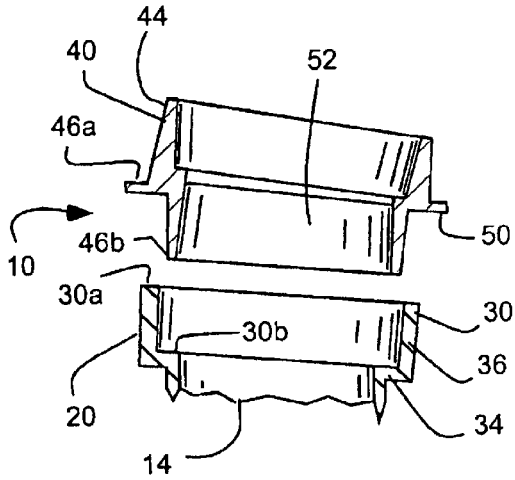
FIG. 3 is a partial exploded cross-sectional side view of the angle adjustable utility access device of FIG. 1.

As illustrated in FIGS. 1–3, an angle adjustable utility access device or valve box assembly 10 is shown for adjusting or varying the angular orientation of a utility or valve box cover 12 with respect to a surface 4, such as a roadway. The utility access 10 can be disposed over a utility 6, and can be surrounded by supporting ground material 8, like fill, concrete or asphalt. As discussed above, the utility 6 can include a valve, switch, meter, etc., with the utility access device 10 allowing access thereto.

The utility access 10 can include a pair of telescoping, elongated sleeves, tubes or pipes, including an upper sleeve 14 and a lower sleeve 16, forming a hollow interior. The upper and lower sleeves 14 and 16 can together have an upper end 20 and a lower end 22, and can be telescopically coupled or engaged so that the overall length of the sleeves or device can be selectively adjusted. The lower sleeve 16 or lower end 22 can be disposed adjacent or immediately above the utility 6, while the upper sleeve 14 or upper end 20 can be disposed adjacent the surface 4.

The lower sleeve 16 can have an enlarged lower end 26 that can be enlarged to fit over and along side the utility 6. Thus, the lower end 26 can have a bell shape to fit over and around, or partially around, a valve, switch, meter, etc. Openings can be formed in sides of the enlarged end to accommodate pipes, lines, wires, etc. The lower sleeve 16 can be slidably received within the upper sleeve 14 so that the upper sleeve overlaps the lower sleeve to resist dirt or fill from entering between the sleeves or into the hollow interior.

The upper sleeve 14 can include a socket 30. The socket 30 can include a flange or shoulder 34 circumscribing and extending laterally or radially outwardly from the sleeve, and a collar 36 circumscribing the shoulder 34 and extending longitudinal therefrom. In addition, the upper sleeve 14 advantageously includes an inclined upper edge 30*a* or 30*b* that is inclined with respect to horizontal (an angle greater than 0). In one aspect, the inclined angle can be greater than 0, and less than 10 degrees. The inclined upper edge 30*a* can be at, or formed by, an upper edge of the collar 36. Thus, the collar 36 can have a longitudinal axis that traverses the longitudinal axis of the sleeve (forming an angle greater than 0, and less than 10 degrees). Alternatively, the upper edge 30*b* can be at, or formed by, the shoulder 34.

An angled ring 40 is rotatably disposed on the inclined upper edge 30*a* or b of the upper sleeve 14. The 5angled ring 40 has opposite upper and lower edges 44 and 46*a* or *b* that are inclined with respect to one another, or which form an angle greater than 0 with respect to one another. In one aspect, the upper and lower edges 44 and 46*a* or *b* can form an angle greater than 0 and less than 10 degrees. The angled ring 40 can include a flange 50 that circumscribes the ring and extending laterally or radially outwardly therefrom, and that is disposed on the angled upper edge 30*a* of the upper sleeve 14. Thus, the flange 50 can form the lower edge 46*a*. In addition, the angled ring 40 can include a protrusion 52 that extends longitudinally from the ring and into the socket 30 on the upper sleeve 14. The protrusion 52 can maintain the ring 40 on the sleeve 14. The protrusion 50 can be disposed on the angled upper edge 30*b* of the shoulder 34. Thus, the protrusion 50 can form the lower edge 46*b*.

It will be appreciated that the angled ring 40 can be selectively rotated on the angled upper edge 30*a* or *b* of the upper sleeve 14 to selectively adjust the angle of the ring 40, and thus the cover 12. The ring 40 and edge 30*a* or *b* can have a horizontal or level orientation in which the cover 12 is substantially horizontally, as shown in FIG. 2. The ring 40 can be rotated to an angled orientation in which the cover 12 forms an angle or incline, as shown in FIG. 1. It will be appreciated that further rotation further increases the incline of the cover 12 to match the surface 4. In one aspect, the ring can be rotated to form an angle or incline up to 20 degrees.

As described above, the upper and lower sleeves 14 and 16 can be adjusted relative to one another to adjust the overall length or height of the device 10. In one aspect, the upper and lower sleeves 14 and 16 can be longitudinally slidable with respect to one another, such as with the lower sleeve 16 slidably received in the upper sleeve 14. A flange 60 can substantially circumscribe a lower end of the upper sleeve 14, and can extend laterally or radially outwardly to engage the fill 8 surrounding the sleeves to resist movement of the upper sleeve.

A method for using the device 10 described above includes positioning the utility access device in a hole extending from the surface 4 to the utility 6. The enlarged portion 26 or lower end 22 of the lower sleeve 16 can be disposed over the utility 6. The upper sleeve 14 can be displaced, by sliding or turning as described above, with respect to the lower sleeve 16 to adjust the height of the device 10, and so that the device 10 extends near the surface 4. It will be appreciated that the height of the device 10 can be adjusted prior to placement in the hole. The angled ring 40 can be rotated on the angled upper edge 30*a* or *b* of the upper sleeve 14 until the top of the ring or cover 12 is substantially parallel with or matches the angle of the surface 4. It will be appreciated that the device 10, or upper sleeve 14, can be rotated to properly orient the cover 12 with the surface 4.

Figure 4:
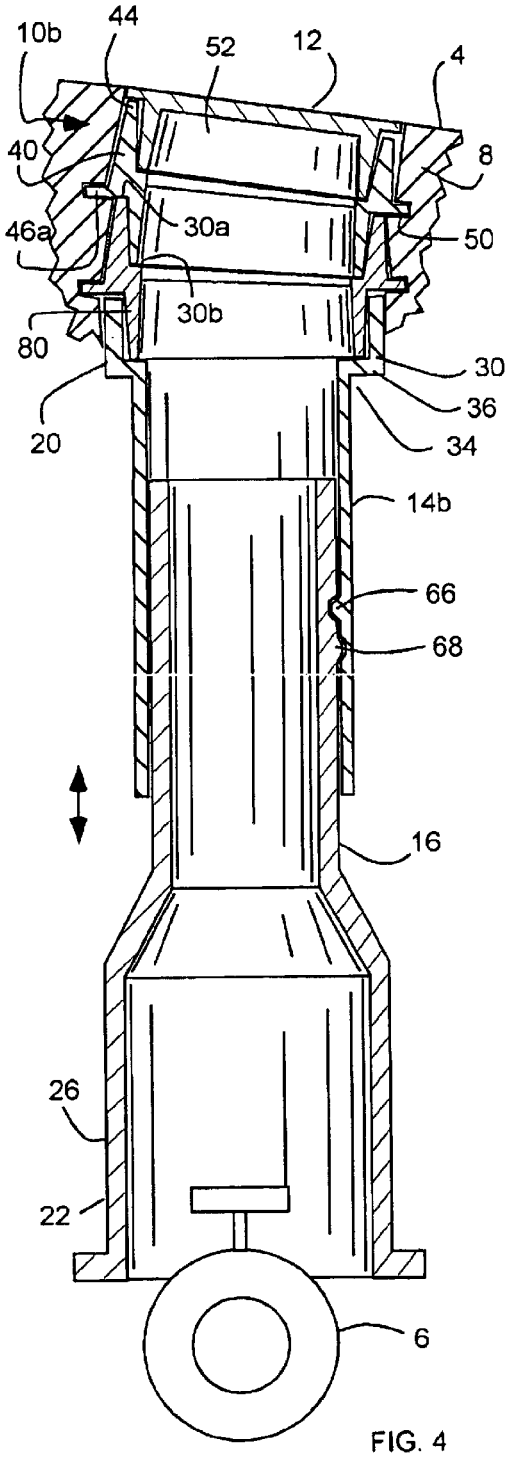
FIG. 4 is a cross-sectional view of another angle adjustable utility access device in accordance with an embodiment of the present invention in an angled configuration with a utility and a surface or roadway.
Figure 5:
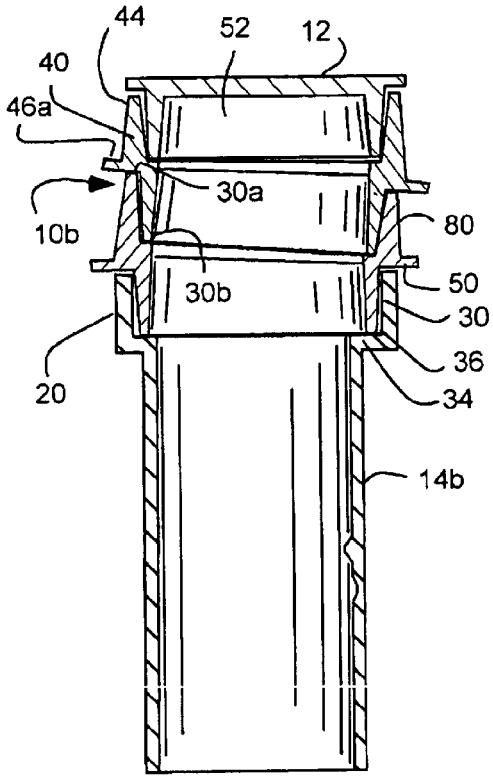
FIG. 5 is a cross-sectional side view of the angle adjustable utility access device of FIG. 4, shown in a level configuration.
Figure 6:
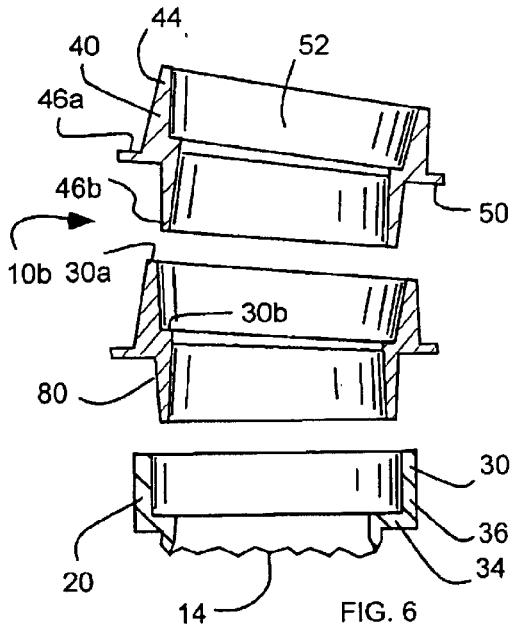
FIG. 6 is a partial exploded cross-sectional side view of the angle adjustable utility access device of FIG. 4.

Referring to FIGS. 4–6, another angle adjustable utility access device or valve box assembly 10*b* is shown that is similar in many respects to that described above. The device 10*b* has an adaptor ring 80 that can be disposed in a standard sleeve or valve box 14*b* to provide the angled upper surface 30*a* or 30*b*. The standard sleeve 14*b* can have a horizontal or level socket 30 or shoulder 34. The adaptor ring 80 can be similar in many respects to the angled ring 40 described above. A method of using the adaptor ring 80 includes disposing the adaptor ring on a standard sleeve with a horizontal edge, and rotating the angled ring 40 with respect to the adaptor ring 80 to achieve the desired angle.

In another aspect, screw threads 66 can be formed on an inner surface of the upper sleeve 14*b*, and screw threads 68 can be formed on an outer surface of the lower sleeve 16. The screw threads 66 and 68 can operatively intermesh or engage so that relative rotation between the sleeves 14*b* and 16 adjusts the height of the device 10. It is of course understood that either of the screw threads 66 or 68 can include only partial screw threads, as is known in the art.

The device 10 or 10*b* can include a coupling for holding the lid 12 onto the angled ring 40 or sleeve 14, such as a bolt that extends through the cover to a nut on the ring or sleeve, a rotatable lever pivotally disposed on the lid to engage the ring or sleeve, etc.

The device also can include means for resisting rotation between the ring 40 and the sleeve 14, including for example, a setscrew, etc.

The device 10 or 10*b*, or sleeves 14 and 16, rings 40 and 80, and cover 12 can be formed from cast iron.

Various aspects of adjustable utility access devices are described in U.S. Pat. No. 6,457,901, issued Oct. 1, 2002, and filed Sep. 1, 2002; U.S. Pat. No. 6,520,713, issued Feb. 18, 2003, and filed Mar. 22, 2001; U.S. Pat. No. 6,524,026, issued Feb. 25, 2003, and filed Mar. 22, 2001; and U.S. patent application Ser. No. 10/262,560, filed Sep. 30, 2002; which are herein incorporated by reference.

It is to be understood that the above-referenced arrangements are illustrative of the application for the principles of the present invention. Numerous modifications and alternative arrangements can be devised without departing from the spirit and scope of the present invention while the present invention has been shown in the drawings and described above in connection with the exemplary embodiments(s) of the invention. It will be apparent to those of ordinary skill in the art that numerous modifications can be made without departing from the principles and concepts of the invention as set forth in the claims.

What is claimed is:

1. A utility access device, comprising:

a) elongated upper and lower sleeves, telescopically coupled to one another, and being displacable with respect to one another so that the sleeves together have an adjustable length;

b) the upper sleeve having a horizontal lower end and an inclined upper edge with an angle with respect to the lower end greater than 0 degrees;

c) an angled ring, rotatably and directly disposed on the inclined upper edge of the upper sleeve;

d) the angled ring having upper and lower opposite edges forming an angle therebetween greater than 0 degrees, the lower edge of the angled ring being directly disposed on the inclined upper edge of the upper sleeve;

e) a cover, removably and directly disposed on the angled ring;

f) the ring being rotatable with respect to the upper sleeve between at least two different orientations, including:

i) a horizontal orientation in which the cover is horizontal; and ii) an angled orientation in which the cover forms an angle with respect to horizontal configured to be flush with the ground surface.

2. A device in accordance with claim 1, further comprising:

an enlarged portion, formed at a lower end of the lower sleeve, configured to extend over and along side a utility.

3. A device in accordance with claim 1, further comprising:

a flange, circumscribing the lower end of the upper sleeve and extending laterally outwardly therefrom, configured to engage fill surrounding the sleeves and to resist movement of the upper sleeve.

4. A device in accordance with claim 1, further comprising:

a shoulder, circumscribing the angled ring and abutting to the inclined upper edge of the upper sleeve.

5. A device in accordance with claim 1, further comprising:

a) a socket, formed at the upper end of the upper sleeve; and b) a protrusion, formed on the angled ring and receivable within the socket of the upper sleeve.

6. A device in accordance with claim 1, wherein the lower sleeve is longitudinally slidable within the upper sleeve.

7. A device in accordance with claim 1, further comprising a utility, disposed at a lower end of the lower sleeve, selected from the group consisting of: a valve, a switch and a meter.

8. A device in accordance with claim 1, further comprising:

a shoulder, extending laterally outwardly from the inclined upper edge of the upper sleeve;

a collar, circumscribing the shoulder and extending longitudinally from the shoulder;

a flange, extending laterally outwardly from the angled ring, and disposed over the collar of the upper sleeve; and a protrusion, extending longitudinally from the angled ring and into the collar of the upper sleeve.

9. A utility access device, comprising:

a) an elongated lower sleeve having a lower end;

b) an enlarged portion, formed at the lower end of the lower sleeve, configured to extend over and along side a utility;

c) an elongated upper sleeve, telescopically engaging the lower sleeve, having an upper end and a horizontal lower end;

d) a socket, formed at the upper end of the upper sleeve;

e) an inclined upper edge, formed at the upper end of the upper sleeve, having an angle with respect to the horizontal lower end of the upper sleeve greater than 0 degrees;

f) an angled ring, rotatably disposed on the inclined upper edge of the upper sleeve;

g) the angled ring having upper and lower opposite edges forming an angle therebetween greater than 0 degrees; and h) a cover, removably disposed on the angled ring.

10. A device in accordance with claim 9, further comprising:

a flange, circumscribing the lower end of the upper sleeve and extending laterally outwardly therefrom, configured to engage fill surrounding the sleeves and to resist movement of the upper sleeve.

11. A device in accordance with claim 9, further comprising:

a shoulder, circumscribing the angled ring and abutting to the inclined upper edge of the upper sleeve.

12. A device in accordance with claim 9, wherein the lower sleeve is longitudinally slidable within the upper sleeve.

13. A device in accordance with claim 9, further comprising a utility, disposed at a lower end of the lower sleeve, selected from the group consisting of: a valve, a switch and a meter.

14. A device in accordance with claim 9, further comprising:

a shoulder, extending laterally outwardly from the inclined upper edge of the upper sleeve;

a collar, circumscribing the shoulder and extending longitudinally from the shoulder;

a flange, extending laterally outwardly from the angled ring, and disposed over the collar of the upper sleeve; and a protrusion, extending longitudinally from the angled ring and into the collar of the upper sleeve.

15. A utility access device, comprising:

a) an elongated lower sleeve having a lower end;

b) an elongated upper sleeve, telescopically engaging the lower sleeve, having an upper end and a horizontal lower end;

c) the upper end of the upper sleeve having an inclined upper edge with an angle with respect to the lower end greater than 0 degrees;

d) a single angled ring, rotatably and directly disposed on the upper sleeve, having upper and lower opposite edges forming an angle therebetween greater than 0 degrees;

e) the lower edge of the angled ring being directly disposed on the inclined upper edge of the upper sleeve; and f) a cover, removably and directly disposed on the angled ring.

16. A device in accordance with claim 15, further comprising:

an enlarged portion, formed at the lower end of the lower sleeve, configured to extend over and along side a utility.

17. A device in accordance with claim 15, further comprising:

a flange, circumscribing the lower end of the upper sleeve and extending laterally outwardly therefrom, configured to engage fill surrounding the sleeves and to resist movement of the upper sleeve.

18. A device in accordance with claim 15, further comprising:

a shoulder, circumscribing the angled ring and abutting to the inclined upper edge of the upper sleeve.

19. A device in accordance with claim 15, further comprising:

a) a socket, formed at the upper end of the upper sleeve; and b) a protrusion, formed on the angled ring and receivable within the socket of the upper sleeve.

20. A device in accordance with claim 15, wherein the lower sleeve is longitudinally slidable within the upper sleeve.

21. A device in accordance with claim 15, further comprising a utility, disposed at the lower end of the lower sleeve, selected from the group consisting of: a valve, a switch and a meter.

22. A device in accordance with claim 15, further comprising:

a shoulder, extending laterally outwardly from the inclined upper edge of the upper sleeve;

a collar, circumscribing the shoulder and extending longitudinally from the shoulder;

a flange, extending laterally outwardly from the angled ring, and disposed over the collar of the upper sleeve; and a protrusion, extending longitudinally from the angled ring and into the collar of the upper sleeve.

* * * * *